US012782081B2

(12) United States Patent
McPherson et al.

(10) Patent No.: US 12,782,081 B2
(45) **Date of Patent: *Nov. 3, 2026**

(54) ARCHERY BOW ACCESSORY ATTACHMENT

(71) Applicant: Mathews Archery, Inc., Sparta, WI (US)

(72) Inventors: Mathew A. McPherson, Norwalk, WI (US); Brandon J. Gann, Sparta, WI (US); Mark J. Hayes, Onalaska, WI (US)

(73) Assignee: Mathews Archery, Inc., Sparta, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/991,209

(22) Filed: Dec. 20, 2024

(65) Prior Publication Data

US 2025/0130008 A1 Apr. 24, 2025

Related U.S. Application Data

(63) Continuation of application No. 18/096,490, filed on Jan. 12, 2023, now Pat. No. 12,203,723.

(60) Provisional application No. 63/300,985, filed on Jan. 19, 2022, provisional application No. 63/425,241, filed on Nov. 14, 2022.

(51) Int. Cl.
*F41B 5/14* (2006.01)

(52) U.S. Cl.
CPC ..... *F41B 5/148* (2013.01); *F41B 5/14* (2013.01); *F41B 5/1426* (2013.01); *F41B 5/1442* (2013.01)

(58) Field of Classification Search
CPC ..... F41B 5/148; F41B 5/14; F41B 5/1426; F41B 5/1442; F41B 5/1403; F41B 5/1484; F41B 5/1488; F41B 5/1492; F41B 5/1496
USPC ..... 124/80, 86, 88, 89
See application file for complete search history.

(56) References Cited

U.S. PATENT DOCUMENTS

| | | | |
|---|---|---|---|
| 1,847,593 | A | 3/1932 | James |
| 2,186,386 | A | 1/1940 | Lowell |
| 2,909,167 | A | 10/1959 | Fredrickson |
| 3,406,675 | A | 10/1968 | Fredrickson |
| 3,491,739 | A | 1/1970 | Scrobell |
| 3,670,712 | A | 6/1972 | Izuta |
| 4,329,972 | A | 5/1982 | Wilson |
| 4,452,222 | A | 6/1984 | Quartino et al. |
| 4,759,337 | A | 7/1988 | Suski |
| 4,788,961 | A | 12/1988 | Toth |
| 4,893,606 | A | 1/1990 | Sisko |

(Continued)

OTHER PUBLICATIONS

Defendant's Answer and Counterclaims, *Mathews Archery* v *Viper Sights*, Case 2:24-cv-01772-MRH, Document 25, filed Mar. 14, 2025, US District Court Western District of Pennsylvania.

(Continued)

*Primary Examiner* — John E Simms, Jr.
(74) *Attorney, Agent, or Firm* — Laabs Intellectual Property

(57) ABSTRACT

In some embodiments, an archery bow comprises a riser comprising a first rail and a second rail. An accessory is supported by the riser. The accessory extends through the first rail and contacts the second rail. A fastener contacts the riser and the accessory. The fastener comprises a central axis that does not intersect the accessory.

24 Claims, 10 Drawing Sheets

(56) References Cited

U.S. PATENT DOCUMENTS 4,974,575 A * 12/1990 Mitchell ..... F41H 3/00 135/901
5,005,554 A 4/1991 Shepley et al.
5,072,716 A 12/1991 Sappington
5,123,396 A 6/1992 Shepley et al.
5,243,957 A 9/1993 Neilson
5,273,022 A 12/1993 Leven
5,379,746 A * 1/1995 Sappington ..... F41G 1/467 124/87
5,400,764 A 3/1995 Spolar et al.
5,433,792 A 7/1995 Darlington
5,553,597 A 9/1996 Sparks
5,657,740 A * 8/1997 Slates ..... F41G 1/467 124/87
5,803,070 A 9/1998 Martin et al.
5,904,134 A 5/1999 Denbow
5,934,266 A 8/1999 Martin et al.
5,944,004 A 8/1999 Goff et al.
D415,812 S 10/1999 Andrews, Jr.
6,085,736 A * 7/2000 Osterhues ..... F41B 5/1426 124/89
RE36,942 E 11/2000 Shepley, Jr. et al.
6,142,133 A 11/2000 Anderson
6,142,134 A 11/2000 Meeks
6,430,822 B1 8/2002 Slates
6,568,382 B2 5/2003 Martin et al.
6,634,348 B2 10/2003 Gallops, Jr.
6,715,481 B1 4/2004 Anderson
6,718,964 B1 4/2004 Graf
6,802,307 B2 10/2004 Leven
6,889,683 B1 5/2005 Smith
6,895,676 B1 5/2005 Mendyk
6,925,721 B2 * 8/2005 Dietz ..... F41G 1/467 124/87
6,938,616 B2 9/2005 Walk
6,968,837 B1 11/2005 Shepley, Jr. et al.
7,066,165 B2 6/2006 Perry
7,318,430 B2 1/2008 Leven
7,347,196 B1 3/2008 Shepley, Jr. et al.
7,832,109 B2 11/2010 Gibbs
7,958,881 B2 6/2011 Silverson
7,987,842 B2 8/2011 McPherson
7,997,258 B2 8/2011 Shepley et al.
7,997,261 B2 * 8/2011 Scaniffe ..... F41G 1/44 124/87
8,166,963 B2 5/2012 Leven
8,225,778 B2 7/2012 Walk et al.
8,347,870 B1 1/2013 Mahutga
8,408,195 B2 4/2013 McPherson
8,418,683 B2 4/2013 Leven
D682,969 S 5/2013 Khoshnood et al.
D682,970 S 5/2013 Khoshnood et al.
D682,971 S 5/2013 Khoshnood et al.
D685,874 S 7/2013 Andrews, Jr. et al.
D691,232 S 10/2013 Khoshnood
8,573,193 B2 11/2013 Khoshnood
8,590,522 B2 11/2013 Khoshnood et al.
8,689,454 B2 4/2014 Pulkrabek
8,833,356 B2 9/2014 Khoshnood
8,839,525 B2 9/2014 Pulkrabek et al.
8,839,775 B2 9/2014 Wasilewski
D718,404 S 11/2014 Barnett
D727,454 S 4/2015 Robinson
9,016,268 B2 4/2015 Leven
9,038,617 B1 5/2015 Khoshnood
D735,830 S 8/2015 Khoshnood
D741,391 S 10/2015 Sui
D755,298 S 5/2016 Akana et al.
9,383,158 B1 7/2016 Khoshnood
9,400,154 B2 7/2016 McPherson
9,429,383 B2 8/2016 Martens
9,500,433 B2 11/2016 McPherson
D775,705 S 1/2017 Khoshnood et al.
D779,617 S 2/2017 Barnett
D779,621 S 2/2017 Salvador
D780,277 S 2/2017 Barnett
9,599,424 B2 3/2017 Derus
9,612,087 B2 4/2017 Summers et al.
9,658,025 B2 5/2017 Trpkovski
D791,898 S 7/2017 Khoshnood et al.
9,752,843 B2 9/2017 Garver et al.
9,829,269 B2 11/2017 McPherson
10,024,630 B2 7/2018 Donovan
10,077,964 B2 9/2018 Summers
D834,113 S 11/2018 Chu
10,295,296 B2 5/2019 Summers
10,330,424 B2 6/2019 Brown
10,393,471 B2 8/2019 McPherson et al.
D863,480 S 10/2019 Miao
D868,194 S 11/2019 Ozanne
D868,195 S 11/2019 Ozanne
10,619,966 B2 4/2020 Ozanne et al.
10,634,448 B2 4/2020 Brown
D884,818 S 5/2020 Hayes
10,655,927 B2 5/2020 Simonds et al.
10,816,304 B2 10/2020 McPherson et al.
11,293,716 B1 4/2022 Dahl
11,549,784 B2 1/2023 Brown
D979,336 S 2/2023 Convey
D1,010,051 S 1/2024 Hayes
11,885,588 B2 1/2024 McPherson et al.
12,013,205 B2 6/2024 McPherson et al.
2009/0107474 A1 4/2009 Silverson
2010/0059639 A1 * 3/2010 Truna ..... F41B 5/14 248/125.1
2011/0120440 A1 5/2011 Stokes
2011/0192385 A1 8/2011 Clark
2012/0260902 A1 10/2012 Felt
2013/0118468 A1 5/2013 Kozlik et al.
2013/0174430 A1 * 7/2013 Pulkrabek ..... F41G 1/467 33/228
2014/0069402 A1 3/2014 McPherson
2014/0069404 A1 3/2014 McPherson
2014/0261354 A1 9/2014 Ross
2015/0013658 A1 * 1/2015 Gibson ..... F41B 5/148 124/88
2015/0184973 A1 7/2015 Martens
2015/0233664 A1 8/2015 McPherson
2019/0323258 A1 10/2019 Ma
2019/0390937 A1 * 12/2019 Mason ..... F41G 1/467
2020/0208938 A1 7/2020 Brown
2020/0340774 A1 10/2020 Summers
2021/0254923 A1 8/2021 Summers et al.
2022/0276019 A1 9/2022 Summers et al.
2023/0221094 A1 7/2023 Yan
2023/0243616 A1 8/2023 McPherson

OTHER PUBLICATIONS

Exhibit 1 to Defendant's Answer and Counterclaims, *Mathews Archery* v *Viper Sights*, Case 2:24-cv-01772-MRH, Document 25-1, filed Mar. 14, 2025, US District Court Western District of Pennsylvania.

Exhibit 2 to Defendant's Answer and Counterclaims, *Mathews Archery* v *Viper Sights*, Case 2:24-cv-01772-MRH, Document 25-2, filed Mar. 14, 2025, US District Court Western District of Pennsylvania.

* cited by examiner

ARCHERY BOW ACCESSORY ATTACHMENT

CROSS-REFERENCE TO RELATED APPLICATIONS

This application is a continuation and claims the benefit of U.S. patent application Ser. No. 18/096,490, filed Jan. 12, 2023, which claims the benefit of U.S. Patent Application No. 63/300,985, filed Jan. 19, 2022, and claims the benefit of U.S. Patent Application No. 63/425,241, filed Nov. 14, 2022, the entire content of each of which are hereby incorporated herein by reference.

BACKGROUND OF THE INVENTION

This invention relates to archery bows and accessories for archery bows. Archery bows are generally known and used to launch arrows. Archery bows are often fitted with various accessories, such as stabilizers, arrow rests, sights, vibration dampers, etc.

Although there is a general desire for a bow to be as small and light as possible, each accessory tends to add weight and bulk, increasing the profile of the bow. Some users remove accessories from a bow when the bow is being configured for travel or storage, for example to allow the bow to fit in a case. Certain accessories are more critical to bow accuracy than others, and the specific placement and orientation of the accessory with respect to the bow riser can be very important. When an accessory is removed and later reinstalled, the specific placement and orientation can change due to tolerances and clearances of parts. If an accessory is attached with multiple screws, even the order of tightening the screws can change the specific placement of the accessory.

Certain accessories intentionally add mass to the bow assembly, such as stabilizers. It is desirable for a stabilizer to be attached to a bow using a strong and rigid connection.

There remains a need for novel archery bow accessory attachment structures that improve upon prior bow structures. There remains a need for archery bow systems that reduce the weight and profile of the bow. There remains a need for archery bow systems that allow an accessory to be removed and reinstalled in the same specific location. There remains a need for stronger attachment mechanisms between an archery bow and an accessory.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, an archery bow comprises a riser comprising a first rail and a second rail. An accessory is supported by the riser. The accessory extends through the first rail and contacts the second rail. A fastener contacts the riser and the accessory. The fastener comprises a central axis that does not intersect the accessory.

In some embodiments, the fastener comprises a wedging surface contacting the accessory, the wedging surface oriented at an angle to the central axis.

In some embodiments, the fastener comprises a crank handle.

In some embodiments, the accessory comprises an octagonal cross-sectional shape.

In some embodiments, the first rail comprises a first aperture and the accessory is positioned in the first aperture.

In some embodiments, the second rail comprises a second aperture and the accessory is positioned in the second aperture.

In some embodiments, the first aperture and the second aperture comprise the same shape. In some embodiments, the first aperture comprises an asymmetrical cross-sectional shape.

In some embodiments, the accessory comprises a plurality of detents and the fastener contacts a detent.

In some embodiments, an archery bow comprises a riser comprising a first rail and a second rail. A stabilizer is supported by the riser. The stabilizer extends through the first rail and contacts the second rail.

In some embodiments, a fastener contacts the riser and the stabilizer. In some embodiments, the fastener comprises a central axis that does not intersect the stabilizer.

In some embodiments, a fastener comprises a wedging surface contacting the stabilizer. In some embodiments, the wedging surface is oriented at an angle to the central axis.

In some embodiments, a fastener comprises a crank handle.

In some embodiments, a stabilizer comprises a plurality of detents and the fastener contacts a detent.

In some embodiments, the bow comprises a shooting axis and a grip. In some embodiments, the grip and the stabilizer are located to a common side of the shooting axis.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
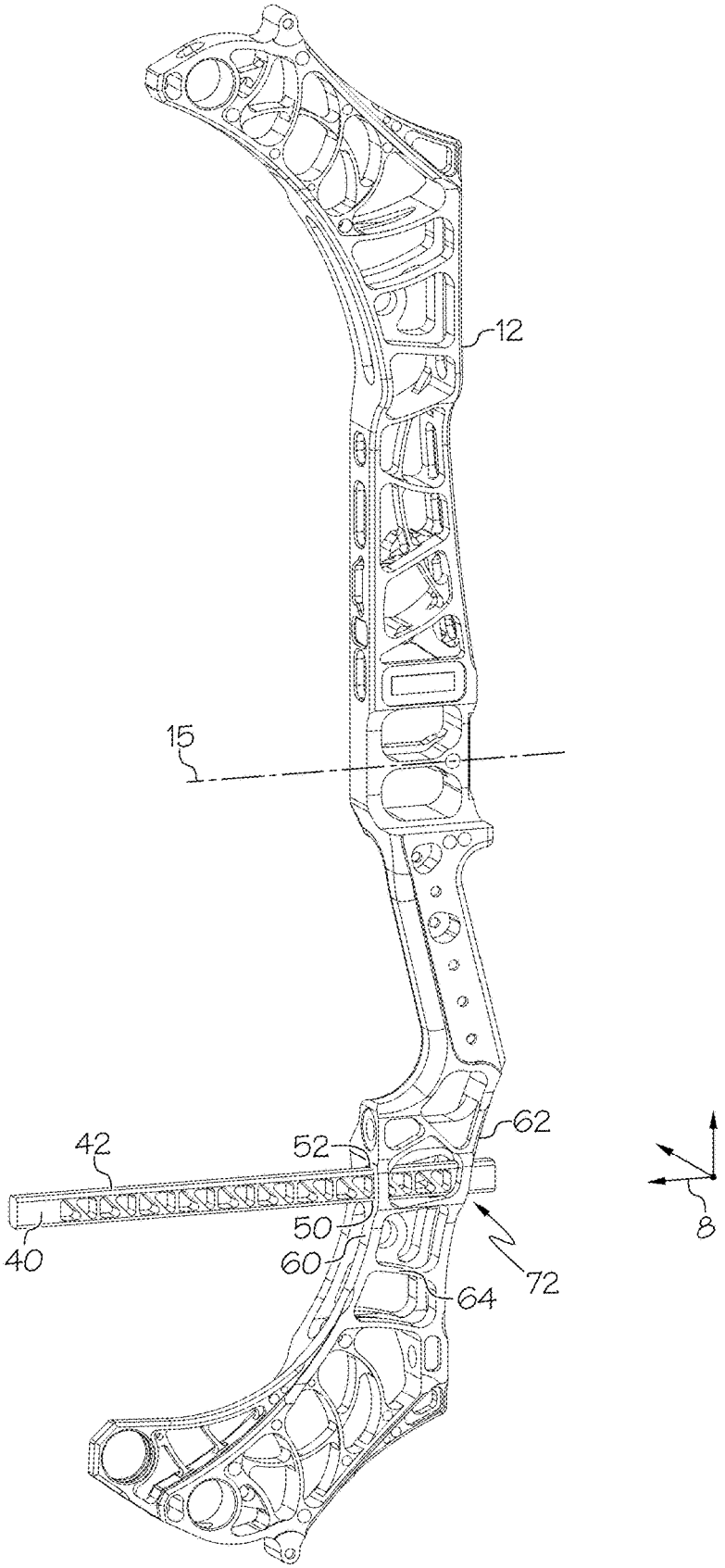
FIG. 1 shows an embodiment of an archery bow riser.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of an archery bow riser 12. Desirably, the riser 12 is suitable to comprise an archery bow, for example comprising limbs and a bowstring.

In some embodiments, the riser 12 comprises a cavity 50 arranged to receive an accessory 40. In some embodiments, an accessory 40 comprises a stabilizer. In some embodiments, an accessory 40 comprises a mounting bar 42 and the mounting bar 42 is oriented in the cavity 50. In some embodiments, a length of the mounting bar 42 is greater than a distance across the riser 12. In some embodiments, a mounting bar 42 positioned in the cavity 50 can protrude from the riser 12 on opposites sides of the cavity 50. In some embodiments, a first outer surface of the riser 12 comprises a first aperture 52 and a second outer surface of the riser 12 comprises a second aperture 72. In some embodiments, an accessory 40 can be attached to the riser 12 with a portion of the accessory 40 oriented in the first aperture 52 and another portion of the accessory 40 oriented in the second aperture 72.

In some embodiments, a fastener 58 is used to secure the accessory 40 with respect to the riser 12.

Figure 2:
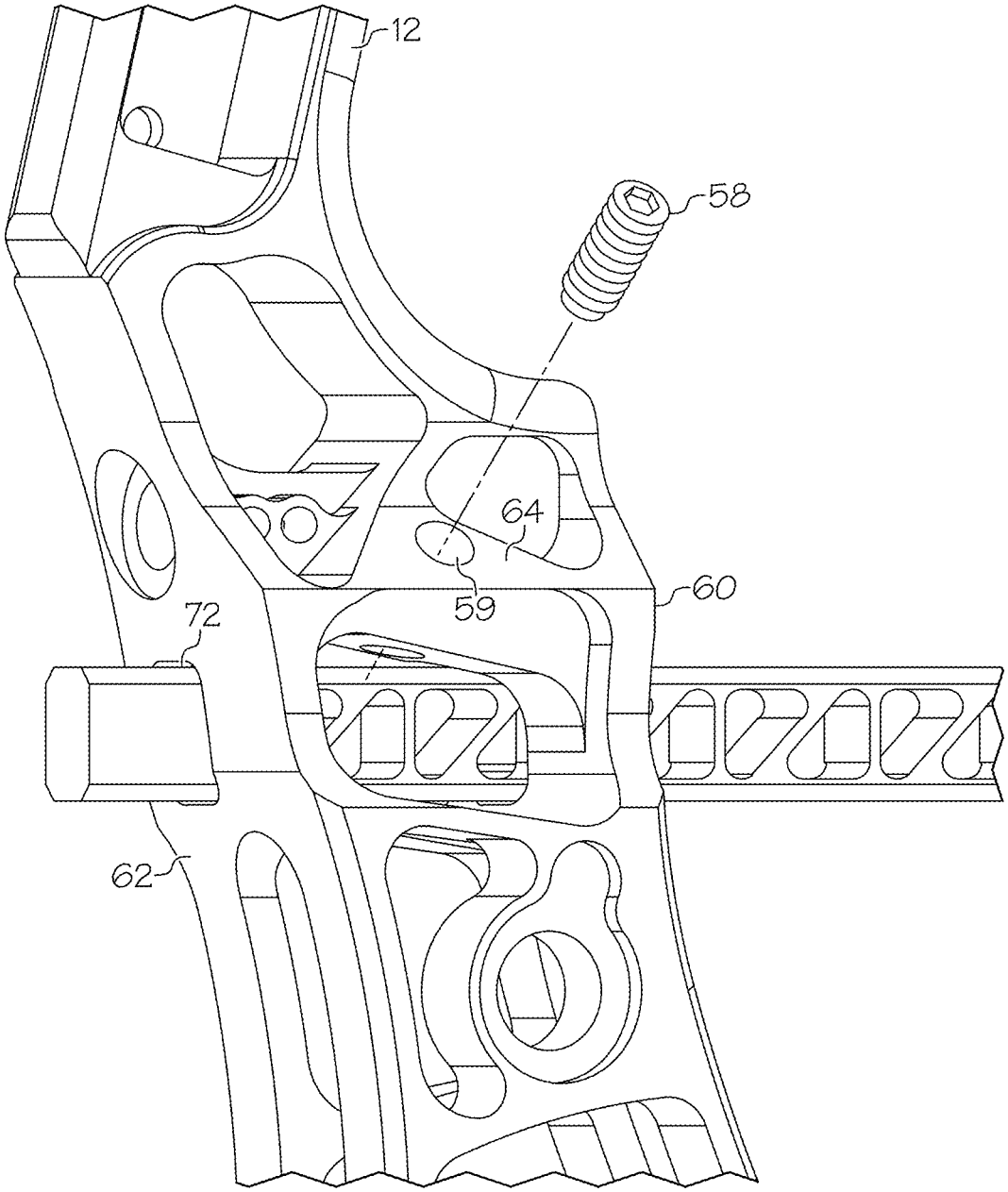
FIG. 2 shows a detail of an embodiment of an accessory engaged with a riser.
Figure 3:
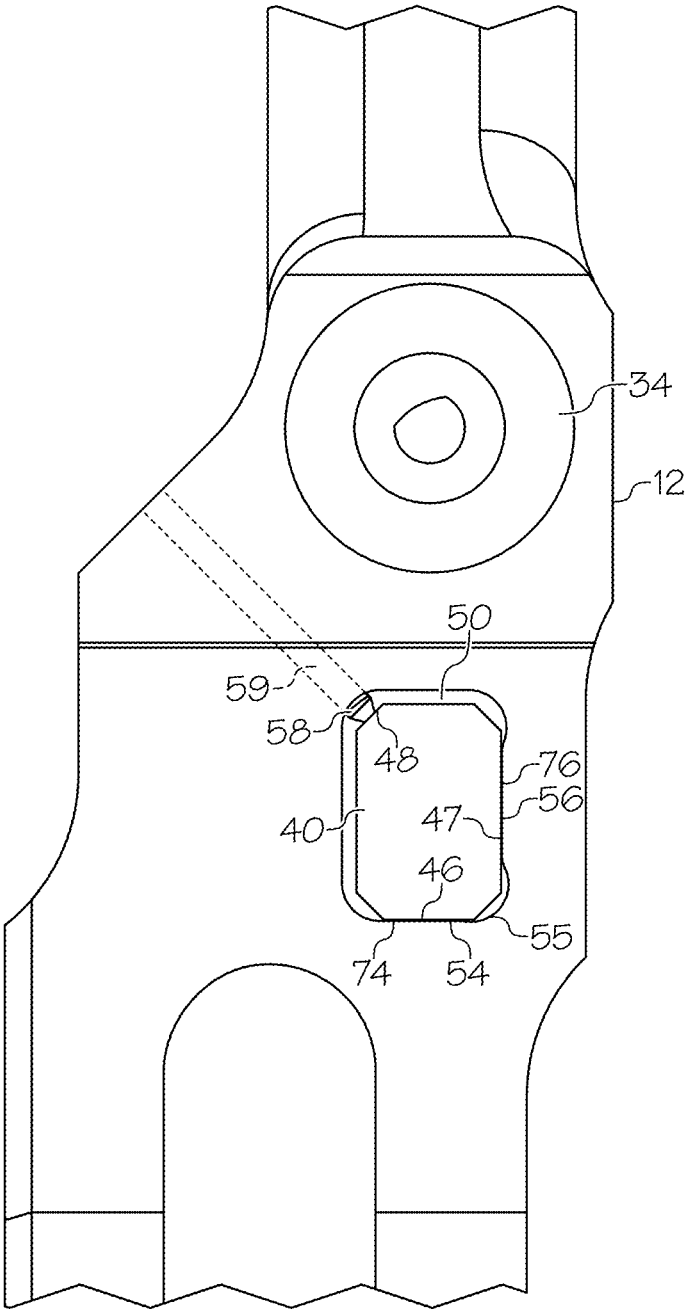
FIG. 3 shows an end view of an embodiment of a riser.

FIGS. 2 and 3 show an embodiment of a riser 12 and an embodiment of an accessory 40 in greater detail. In some embodiments, a riser 12 comprises an accessory bushing 34, for example as described in U.S. Pat. No. 11,181,335. In some embodiments, an accessory such as a stabilizer can be attached to the accessory bushing 34, for example using a threaded stud arranged to engage complimentary threads in the bushing 34. In some embodiments, the riser 12 further comprises a cavity 50 as described herein for receiving an accessory 40, such as a stabilizer, without using a threaded stud.

In some embodiments, an accessory 40 comprises a mounting bar 42. In some embodiments, a mounting bar 42 can comprise any suitable cross-sectional shape.

In some embodiments, the riser 12 is configured to engage a fastener 58 arranged to tighten against the accessory 40. In some embodiments, the riser 12 comprises a threaded cavity 59 arranged to receive and engage the fastener 58. In some embodiments, the fastener 58 is arranged to extend into the cavity 50. In some embodiments, the fastener 58 engages a detent 43 of the accessory 40.

In some embodiments, the fastener 58, and the threaded cavity 59, are oriented at a non-zero, non-orthogonal angle to one or more of the three mutually perpendicular coordinate axes 8. For example, if a shooting axis 15 of the bow 10 extends along a z-axis, then the fastener 58 shown in FIG. 3 is oriented at a non-zero angle to the x-axis and to the y-axis. In some embodiments, the fastener 58, and the threaded cavity 59, are oriented at a non-zero, non-orthogonal angle to at least two of the three mutually perpendicular coordinate axes 8.

In some embodiments, a central axis 68 of the fastener 58 extends into the cavity 50. In some embodiments, the central axis 68 of the fastener 58 is arranged to intersect the accessory 40.

In some embodiments, a riser 12 comprises integral structural members and various cells. In some embodiments, a riser 12 comprises a first rail 60 defining a first surface (e.g. front surface) of the riser 12 and a second rail 62 defining a second surface (e.g. rear surface) of the riser 12. In some embodiments, under the loading experienced in a brace condition of the bow 10, the first rail 60 comprises a tension rail and the second rail 62 comprises a compression rail.

In some embodiments, the riser 12 comprises a plurality of connecting members 64. In some embodiments, connecting members 64 extend between the first rail 60 and the second rail 62. In some embodiments, a connecting member 64 extends between a rail 60, 62 and another connecting member 64. In some embodiments, a connecting member 64 extends between other connecting members 64. In some embodiments, a connecting member 64 comprises the threaded cavity 59.

In some embodiments, the cavity 50 comprises a first aperture 52 formed in the first rail 60. In some embodiments, the first aperture 52 comprises a plurality of support portions arranged to support an accessory 40. In some embodiments, the first aperture 52 comprises a first support portion 54. In some embodiments, the first aperture 52 comprises a second support portion 56 spaced apart from the first support portion 54. In some embodiments, the first support portion 54 is oriented at an angle to the second support portion 56.

In some embodiments, the cavity 50 comprises a second aperture 72 formed in the second rail 62. In some embodiments, the second aperture 72 comprises a plurality of support portions arranged to support an accessory 40. In some embodiments, the second aperture 72 comprises a first support portion 74. In some embodiments, the second aperture 72 comprises a second support portion 76 spaced apart from the first support portion 74.

In some embodiments, the first support portion 54 of the first aperture 52 and the first support portion 74 of the second aperture 72 comprise similar shapes. In some embodiments, a shape of the first aperture 52 is similar to a shape of the second aperture 72.

In some embodiments, a first support portion 54, 74 and a second support portion 56, 76 are arranged to self-align an accessory 40 with respect to the riser 12 when loaded by the fastener 58. In some embodiments, the accessory 40 contacts portions of the support portions 54, 56 that comprise diverging surfaces. In some embodiments, the accessory 40 contacts portions of the support portions 54, 56 having tangents that are diverging. In some embodiments, the fastener 58 is located within an angle defined by the support portions 54, 56.

In some embodiments, an accessory 40 comprises a first surface 46, a second surface 47 and a third surface 48. In some embodiments, the first surface 46 contacts a first support portion 54 and the second surface 47 contacts a second support portion 56 the first aperture 52, but the accessory 40 does not contact any other portion of the first aperture 52. In some embodiments, the fastener 58 contacts the third surface 48. In some embodiments, the third surface 48 is oriented at a non-zero angle to the first surface 46 and is oriented at a non-zero angle to the second surface 47.

In some embodiments, the first surface 46 is oriented in an orthogonal plane defined by two of the three mutually perpendicular coordinate axes 8. For example, in some embodiments, the first surface 46 is oriented in an X-Z plane. In some embodiments, the second surface 47 is oriented in an orthogonal plane defined by two of the three mutually perpendicular coordinate axes 8. For example, in some embodiments, the second surface 47 is oriented in a Y-Z plane. In some embodiments, the first surface 46 is orthogonal to the second surface 47. In some embodiments, the third surface 48 is oriented non-parallel to each of the three reference planes defined by the three mutually perpendicular coordinate axes 8.

In some embodiments, a first angle is defined between the first surface 46 and the third surface 48. In some embodiments, a second angle is defined between the second surface 47 and the third surface 48. In some embodiments, the first angle is equal to the second angle. In some embodiments, the first angle is different from the second angle. In some embodiments, a sum of the first angle plus the second angle equals 90 degrees.

In some embodiments, the first aperture 52 comprises an enlarged portion 55 located between the first support portion 54 and the second support portion 56. In some embodiments, the enlarged portion 55 does not contact an accessory 40 oriented in the first aperture 52. In some embodiments, the enlarged portion 55 is concave with respect to the first aperture 52.

In some embodiments, an accessory 40 comprises an octagonal cross-sectional shape.

Figure 4:
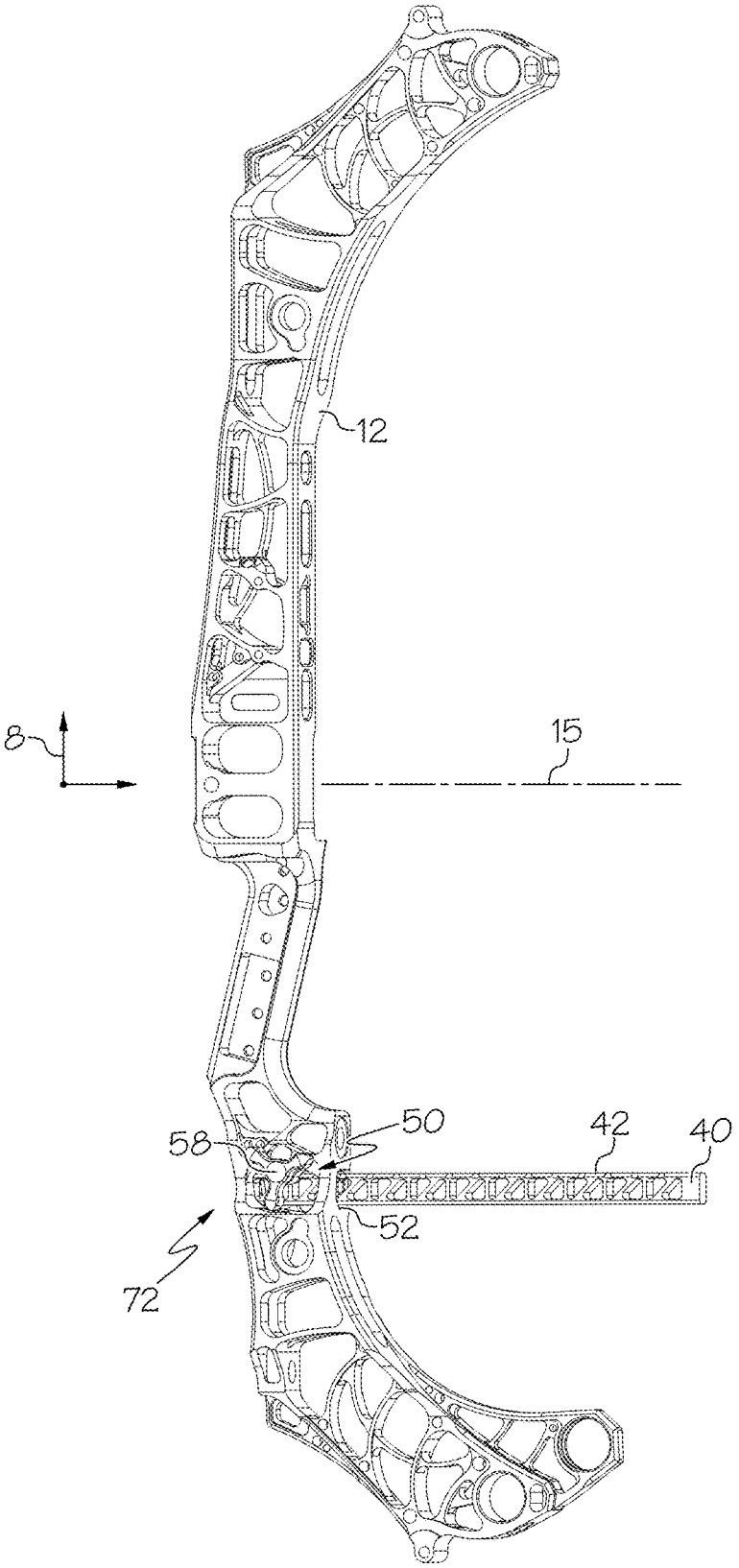
FIGS. 4-6 show another embodiment of a riser engaging an accessory.
Figure 5:
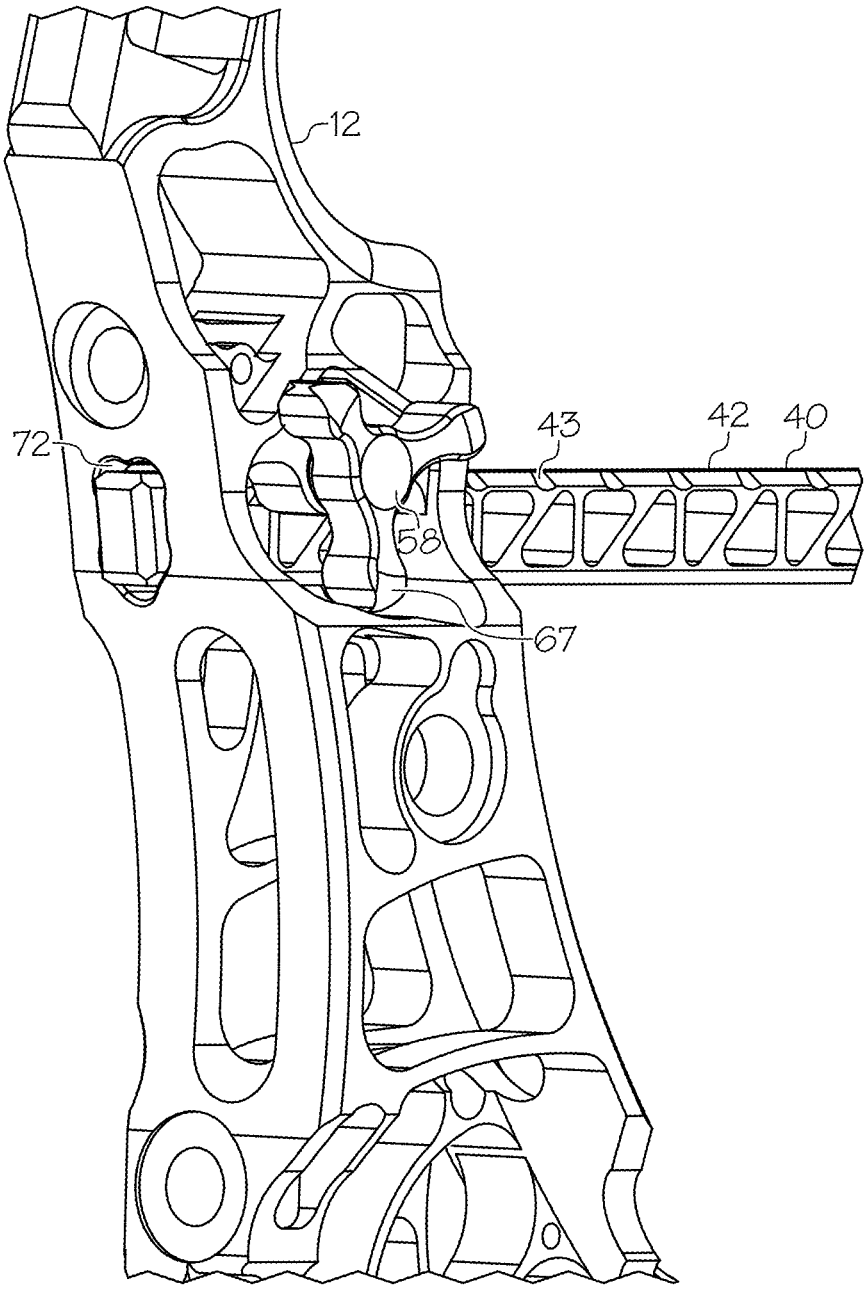
Figure 6:
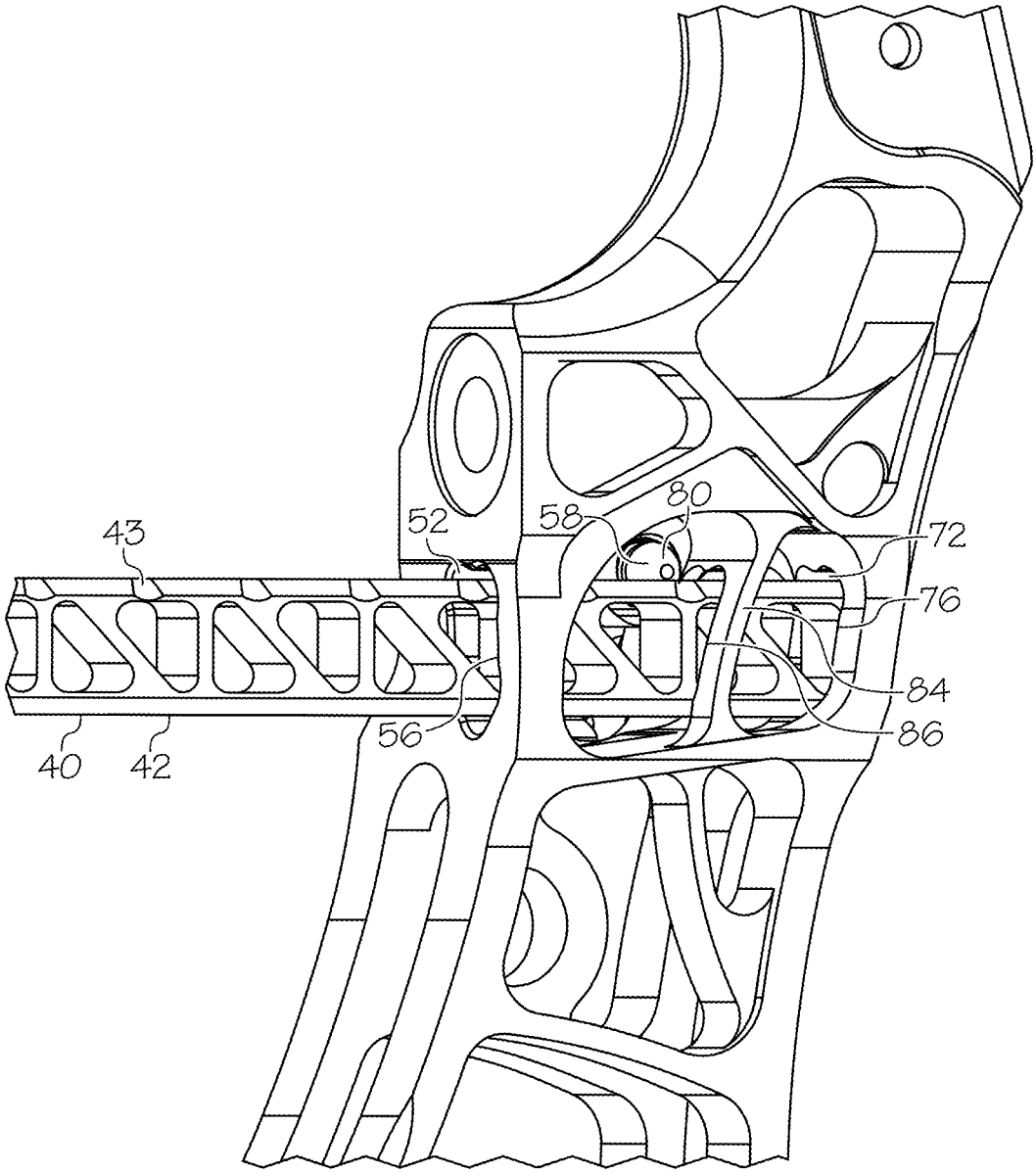
Figure 7:
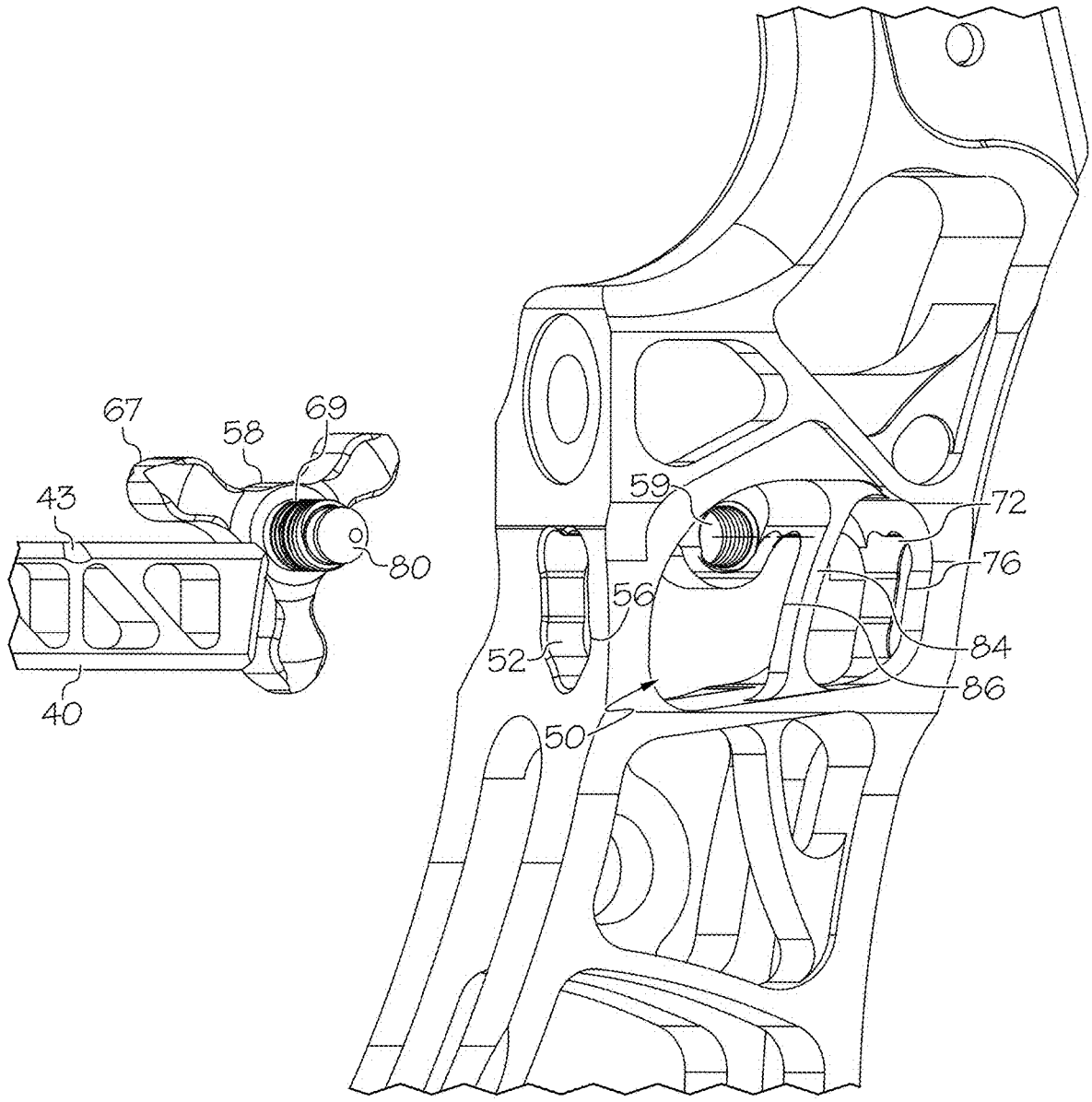
FIGS. 7 and 8 show exploded views of the embodiment shown in FIGS. 4-6.
Figure 8:
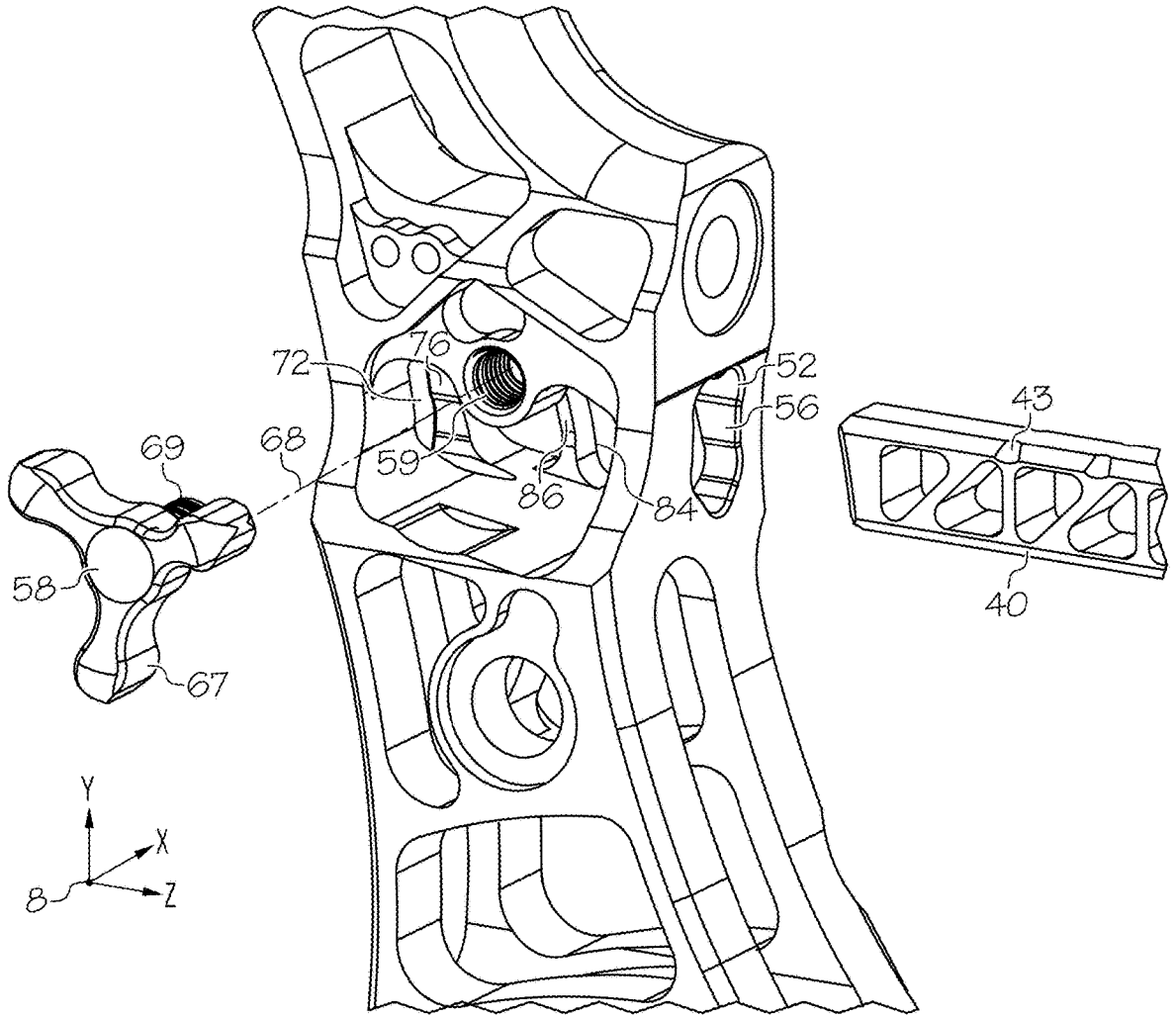
Figure 9:
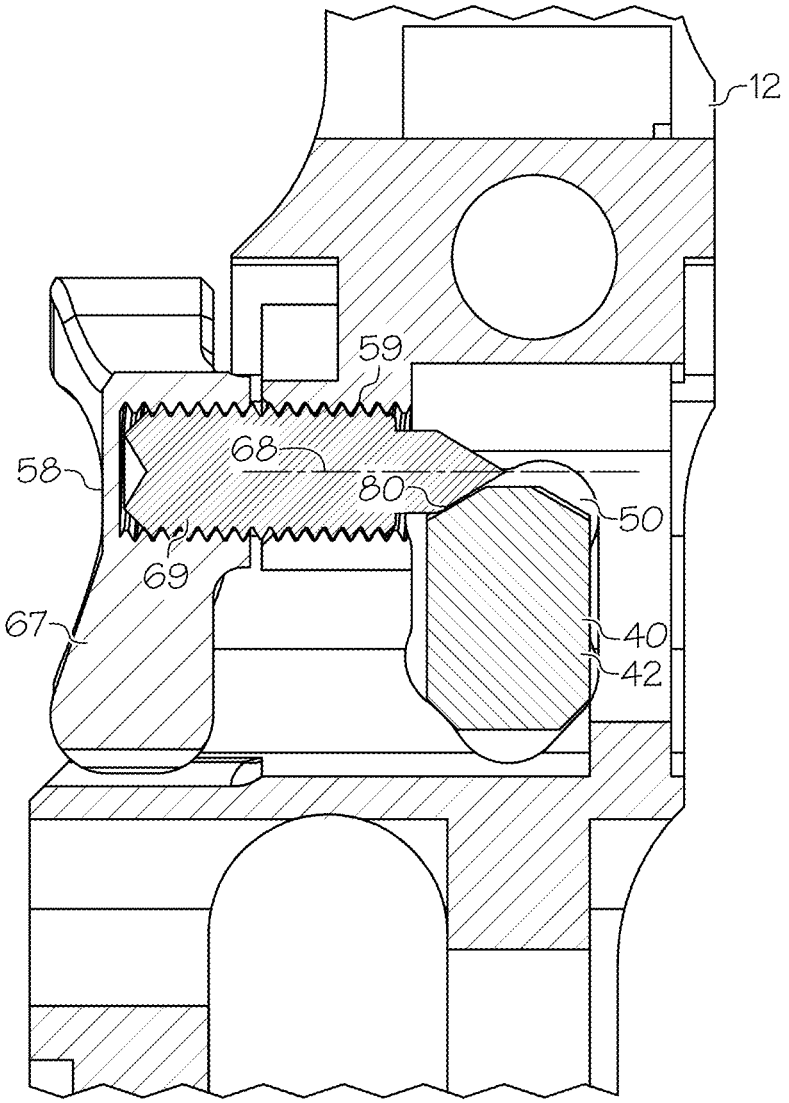
FIG. 9 shows a cross-sectional view of the embodiment shown in FIGS. 4-6.

FIGS. 4-6 show another embodiment of an archery bow riser 12, and FIGS. 7 and 8 show exploded views. FIG. 9 shows a cross-sectional view. Desirably, the riser 12 is suitable to comprise an archery bow, for example comprising limbs and a bowstring. In some embodiments, the riser 12 comprises a cavity 50 arranged to receive an accessory 40. In some embodiments, a fastener 58 is used to secure the accessory 40 with respect to the riser 12.

In some embodiments, a fastener 58 is constructed and arranged to attach the accessory 40 to the riser 12 without using a tool such as a driver or allen wrench. In some embodiments, a fastener 58 is arranged to be turned by hand. In some embodiments, a fastener 58 comprises a crank handle 67. In some embodiments, a fastener 58 comprises a stem 69. In some embodiments, a crank handle 67 extends orthogonally to a central axis 68 of the fastener 58 and allows the fastener 58 to be rotated about the central axis 68. In some embodiments, a fastener 58 comprises multiple crank handles 67. In some embodiments, multiple crank handles 67 are equally distributed about the central axis 68.

In some embodiments, a fastener 58 comprises a wedging surface 80 oriented at an angle to the central axis 68 of the fastener 58. In some embodiments, a wedging surface 80 is arranged to abut an accessory 40. In some embodiments, a wedging surface 80 is arranged to engage a detent 43 on the accessory 40. In some embodiments, a wedging surface 80 is oriented non-parallel and non-orthogonal to the central axis 68 of the fastener 58. A wedging surface 80 can be oriented at any suitable angle to the central axis 68. In some embodiments, a wedging surface 80 is oriented at an angle to the central axis 68 of thirty degrees to sixty degrees. In some embodiments, a wedging surface 80 is oriented at an angle to the central axis 68 of forty degrees to fifty degrees. In some embodiments, the angle is forty-five degrees.

In some embodiments, a central axis 68 of the fastener 58 does not intersect the accessory 40. In some embodiments, the central axis 68 extends orthogonal to a longitudinal axis of the accessory 40. In some embodiments, the central axis 68 extends through a portion of the cavity 50 that is not occupied by the accessory 40.

In some embodiments, the fastener 58, and the threaded cavity 59, are oriented parallel to one of the three mutually perpendicular coordinate axes 8. For example, if a shooting axis 15 of the bow 10 extends along a z-axis, then the fastener 58 can be parallel to the x-axis. In some embodiments, a central axis 68 of the fastener 58 is oriented orthogonal to a shooting axis of the bow.

In some embodiments, the cavity 50 is defined by a first aperture 52 and a second aperture 72. In some embodiments, the cavity 50 is at least partially defined by a support member 84. In some embodiments, a support member 84 is generally aligned with the threaded cavity 59 along a length of the accessory 40, whereas the first aperture 52 and second aperture 72 may be offset from the threaded cavity 59 along a length of the accessory 40. In some embodiments, the support member 84 comprises a support surface 86 arranged to contact the accessory 40. In some embodiments, the support surface 86 helps prevent deformation of the accessory 40 when the fastener 58 is tightened. In some embodiments, the support surface 84 comprises a shape similar to the support portions 56, 76 of the first aperture 52 and second aperture 72, respectively. In some embodiments, the support surface 84 and the support portions 56, 76 are oriented on a common plane.

In some embodiments, the riser 12 comprises a grip. In some embodiments, the accessory 40 and the grip are located to a common side of the shooting axis 15. In some embodiments, the grip and the accessory 40 are located below the shooting axis 15. In some embodiments, an archery sight is oriented above the shooting axis 15. In some embodiments, the accessory 40 and an archery sight are located on opposite sides of the shooting axis 15.

In some embodiments, an accessory 40 comprises an archery bow stabilizer. In some embodiments, an accessory 40 is attached to the riser 12 at one end and is arranged to support weights at the other end.

Figure 10:
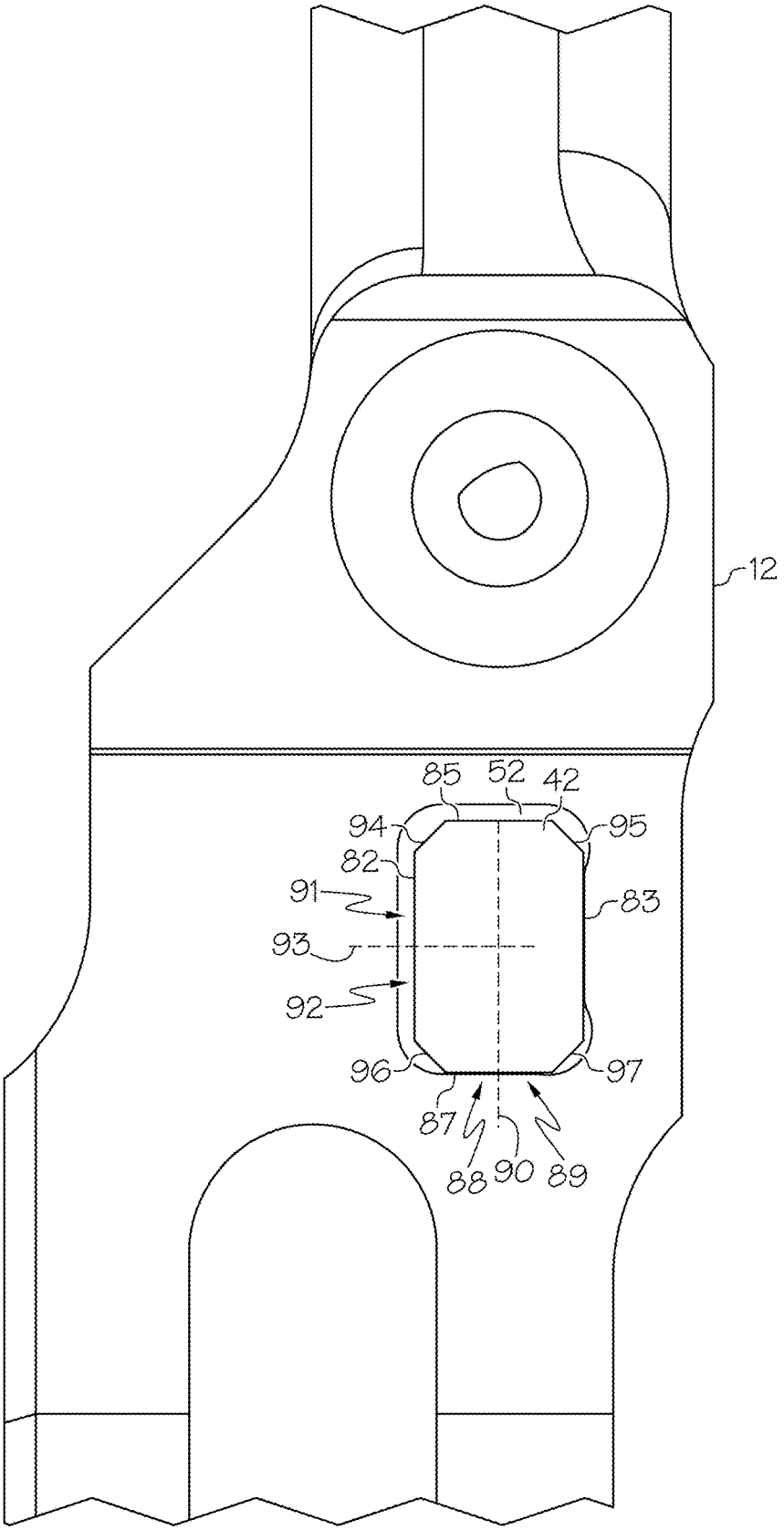
FIG. 10 shows a view similar to FIG. 3.

FIG. 10 shows a riser 12 having an aperture 52 and a mounting bar 42 in the aperture 52. The mounting bar 42 has a first side surface 82 that is at least substantially parallel to a second side surface 83. The mounting bar 42 has a top surface 85 that is at least substantially parallel to a bottom surface 87. The top surface 85 is at least substantially orthogonal to the first side surface 82. The mounting bar 42 has a first angled surface 94 extending between the first side surface 82 and the top surface 85, which is oriented at an angle to the first side surface 82 and oriented at an angle to the top surface 85. The mounting bar 42 has a second angled surface 95 extending between the top surface 85 and the second side surface 83, which is at least substantially orthogonal to the first angled surface 94. The mounting bar 42 has a third angled surface 96 extending between the bottom surface 87 and the first side surface 82, which is at least substantially orthogonal to the first angled surface 94. The mounting bar 42 has a fourth angled surface 97 extending between the bottom surface 87 and the second side surface 83, which is at least substantially parallel to the first angled surface 94. The mounting bar 42 has a non-circular cross-sectional shape. The cross-sectional shape has a first side half 88 that is symmetrical with a second side half 89 across a first bisecting axis 90. The cross-sectional shape has a top half 91 that is symmetrical with a bottom half 92 across a second bisecting axis 93.

The entire content of U.S. Patent Application No. 63/167,511, filed Mar. 29, 2021, U.S. Patent Application No. 63/300,985, filed Jan. 19, 2022, U.S. patent application Ser. No. 17/707,757, filed Mar. 29, 2022 and U.S. Patent Application No. 63/425,241, filed Nov. 14, 2022, are each hereby incorporated herein by reference.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention.

The invention claimed is:

1. An archery stabilizer arranged for use with an archery bow that comprises a riser comprising a first rail, a second rail, a threaded cavity and a fastener, the first rail comprising a first aperture fully surrounded by the first rail, the first aperture comprising a non-circular first cross-sectional shape comprising a first support portion, a second support portion and an enlarged portion located between the first support portion and the second support portion, the first cross-sectional shape being fixed, the second rail comprising a second aperture, the fastener comprising a central axis and a wedging surface, the stabilizer comprising:

a mounting bar shaped to be supported by the riser, the mounting bar comprising a second cross-sectional shape different from the first cross-sectional shape, the second cross-sectional shape being non-circular and comprising a first side surface and a second side surface at least substantially parallel to the first side surface, a top, a bottom, a first angled surface extending from the first side surface toward the top, a second angled surface extending from the second side surface toward the top, a third angled surface extending from the first side surface toward the bottom and a fourth angled surface extending from the second side surface toward the bottom, the second cross-sectional shape comprising a first side half symmetrical with a second side half across a bisecting axis, the mounting bar comprising an orientation extending through the first aperture and contacting the second rail, the first support portion contacting the mounting bar, the second support portion contacting the second side surface, the enlarged portion not contacting the mounting bar, wherein the wedging surface contacts the first angled surface and the central axis does not intersect the mounting bar.

2. The archery stabilizer of claim 1, the mounting bar comprising a plurality of detents, each of said plurality of detents engagable with the fastener.

3. The archery stabilizer of claim 1, the first angled surface comprising a detent, the wedging surface contacting the detent.

4. The archery stabilizer of claim 1, the mounting bar comprising a plurality of apertures extending from the first side surface to the second side surface.

5. The archery stabilizer of claim 1, the mounting bar comprising a top surface oriented at least substantially orthogonal to the first side surface and a bottom surface oriented at least substantially parallel to the top surface.

6. The archery stabilizer of claim 5, the first angled surface extending to the top surface.

7. The archery stabilizer of claim 6, comprising a plurality of detents extending into the second angled surface.

8. The archery stabilizer of claim 6, the second angled surface extending to the top surface.

9. The archery stabilizer of claim 6, the third angled surface extending to the bottom surface.

10. The archery stabilizer of claim 1, wherein the mounting bar is shaped to extend through the second aperture.

11. The archery stabilizer of claim 1, comprising a weight supported by the mounting bar.

12. The archery stabilizer of claim 1, the third angled surface contacting the first support portion.

13. An archery stabilizer arranged for use with an archery riser comprising a first rail, a second rail, a threaded cavity and a fastener, the first rail comprising a first aperture fully surrounded by the first rail, the first aperture comprising a non-circular first cross-sectional shape, the first cross-sectional shape being fixed, the second rail comprising a second aperture, the fastener comprising a stem comprising screw threads and a conical surface, the archery stabilizer comprising:

a mounting bar shaped to be slidably engaged with the riser, the mounting bar comprising a second cross-sectional shape different from the first cross-sectional shape, the second cross-sectional shape being non-circular, the second cross-sectional shape comprising a first side surface and a second side surface at least substantially parallel to the first side surface, a top, a bottom, a first angled surface extending from the first side surface toward the top, a second angled surface extending from the second side surface toward the top, the second cross-sectional shape comprising a first side half symmetrical with a second side half across a first bisecting axis;

the mounting bar shaped to extend through the first aperture and slide with respect to the first rail between a first position and a second position, the mounting bar arranged to contact the first rail, the fastener and the second rail, the first angled surface arranged to contact the conical surface.

14. The archery stabilizer of claim 13, comprising a weight supported by the mounting bar.

15. The archery stabilizer of claim 13, the mounting bar comprising a first detent and a second detent, the first detent contacting the fastener in the first position, the second detent contacting the fastener in the second position.

16. The archery stabilizer of claim 15, comprising a weight supported by the mounting bar.

17. The archery stabilizer of claim 16, the mounting bar comprising an octagonal cross-sectional shape.

18. The archery stabilizer of claim 17, the mounting bar comprising a top half symmetrical with a bottom half across a second bisecting axis.

19. The archery stabilizer of claim 13, the mounting bar comprising a longitudinal axis, the mounting bar operable to move in the direction of the longitudinal axis between the first position and the second position.

20. The archery stabilizer of claim 13, the mounting bar comprising an octagonal cross-sectional shape.

21. The archery stabilizer of claim 13, the mounting bar comprising a top half symmetrical with a bottom half across a second bisecting axis.

22. An archery stabilizer arranged for use with an archery riser comprising a first rail, a second rail, a threaded cavity and a fastener, the first rail comprising a first aperture fully surrounded by the first rail, the first aperture comprising a non-circular first cross-sectional shape comprising a first support portion, a second support portion and an enlarged portion located between the first support portion and the second support portion, the first cross-sectional shape being fixed, the second rail comprising a second aperture, the fastener comprising a stem comprising screw threads and a conical surface, the archery stabilizer comprising:

a mounting bar shaped to be slidably engaged with the riser, the mounting bar comprising a second cross-sectional shape different from the first cross-sectional shape, the second cross-sectional shape being non-circular, the second cross-sectional shape comprising a first side surface and a second side surface at least substantially parallel to the first side surface, a top, a bottom, a first angled surface extending from the first side surface toward the top, a second angled surface extending from the second side surface toward the top, the second cross-sectional shape comprising a first side half symmetrical with a second side half across a first bisecting axis;

the mounting bar shaped to extend through the first aperture and slide with respect to the first rail between a first position and a second position, the mounting bar arranged to contact the first rail, the fastener and the second rail, the first angled surface arranged to contact the conical surface, the mounting bar contacting the first support portion, the second side surface contacting the second support portion, the enlarged portion not contacting the mounting bar.

23. The archery stabilizer of claim 22, the mounting bar comprising a third angled surface extending from the first side surface toward the bottom, the third angled surface contacting the first support portion.

24. An archery stabilizer arranged for use with an archery bow that comprises a riser comprising a first rail, a second rail, a threaded cavity and a fastener, the first rail comprising a first aperture fully surrounded by the first rail, the first aperture comprising a non-circular first cross-sectional shape comprising a first support portion, a second support portion and an enlarged portion located between the first support portion and the second support portion, the first cross-sectional shape being fixed, the second rail comprising a second aperture, the fastener comprising a central axis and a stem comprising screw threads and a conical wedging surface, the stabilizer comprising:

a mounting bar shaped to be supported by the riser, the mounting bar comprising a second cross-sectional shape different from the first cross-sectional shape, the second cross-sectional shape being non-circular and comprising a first side surface and a second side surface at least substantially parallel to the first side surface, a top, a bottom, a first angled surface extending from the first side surface toward the top, a second angled surface extending from the second side surface toward the top, a third angled surface extending from the first side surface toward the bottom and a fourth angled surface extending from the second side surface toward the bottom, the second cross-sectional shape comprising a first side half symmetrical with a second side half across a bisecting axis, the mounting bar comprising an orientation extending through the first aperture and contacting the first rail, the fastener, and the second rail, the first support portion contacting the third angled surface, the second support portion contacting the second side surface, the enlarged portion not contacting the mounting bar, wherein the conical wedging surface contacts the first angled surface and the central axis does not intersect the mounting bar.

* * * * *